US011040810B1

(12) United States Patent
Charm

(10) Patent No.: US 11,040,810 B1
(45) Date of Patent: Jun. 22, 2021

(54) SELF-OPENING PACKAGING WITH CHILD-RESISTANT CLOSURE

(71) Applicant: PLANET CANIT, LLC, Highland Park, IL (US)

(72) Inventor: Hui Ho Charm, Kwai Chung (HK)

(73) Assignee: Planet Canit, LLC, Highland Park, IL (US)

( * ) Notice: Subject to any disclaimer, the term of this patent is extended or adjusted under 35 U.S.C. 154(b) by 14 days.

(21) Appl. No.: 16/709,564

(22) Filed: Dec. 10, 2019

(51) Int. Cl.
*B65D 50/06* (2006.01)
*B65D 43/22* (2006.01)
*B65D 43/16* (2006.01)

(52) U.S. Cl.
CPC ..... *B65D 50/06* (2013.01); *B65D 43/164* (2013.01); *B65D 43/22* (2013.01)

(58) Field of Classification Search
CPC ..... B65D 11/12; B65D 43/22; B65D 5/38; B65D 43/20; B65D 50/046; B65D 2215/04; B65D 2215/00; B65D 2215/02; B65D 50/06; B65D 43/164
See application file for complete search history.

(56) References Cited

U.S. PATENT DOCUMENTS 3,888,350 A * 6/1975 Horvath ..... B65D 50/045 206/531
4,174,034 A * 11/1979 Hoo ..... B65D 11/12 206/1.5
5,082,137 A * 1/1992 Weinstein ..... B65D 43/20 206/1.5
5,163,559 A 11/1992 Bunin
6,880,729 B2 4/2005 Stull et al.
7,353,969 B2 4/2008 McHutchinson
8,292,101 B1 10/2012 Bragg et al.
9,938,042 B1 * 4/2018 Aryanpanah ..... B65D 50/04
10,232,990 B2 3/2019 Sang et al.
D859,686 S 9/2019 Charm
2004/0007595 A1 1/2004 Stull et al.
(Continued)

FOREIGN PATENT DOCUMENTS

CN 2787582 Y 6/2006
CN 2866392 Y 2/2007
(Continued)

*Primary Examiner* — Shawn M Braden
(74) *Attorney, Agent, or Firm* — Foley & Lardner LLP

(57) ABSTRACT

A self-opening container incorporates a child-resistant closure mechanism, which prevents operation of an opening mechanism of the container when the child-resistant (CR) closure mechanism is in a locked configuration. The container includes a container body, lid, and inner casing slidably mounted in an inner cavity of the container body. The opening mechanism is configured to automatically raise the inner casing and open the lid, thereby providing access to container contents. The child-resistant closure mechanism includes a button or bar slidably mounted to the bottom of the container to move between first position and second positions, corresponding to locked and unlocked configurations. The button or bar is coupled to a latch member that abuts against a catch surface of the inner casing when the CR mechanism is in its locked configuration, and does not abut against the catch structure when the CR mechanism is in its unlocked configuration.

20 Claims, 4 Drawing Sheets

(56) References Cited

U.S. PATENT DOCUMENTS

| | | | | |
|---|---|---|---|---|
| 2007/0284277 | A1* | 12/2007 | Gnepper | B65D 11/12 206/528 |
| 2009/0152134 | A1* | 6/2009 | Katsis | A24F 27/00 206/96 |
| 2015/0315532 | A1 | 11/2015 | Bergbohm et al. | |
| 2017/0137184 | A1 | 5/2017 | Burek et al. | |
| 2017/0217658 | A1* | 8/2017 | Whitehurst | B65D 5/38 |
| 2018/0086518 | A1 | 3/2018 | Charm | |
| 2018/0305092 | A1* | 10/2018 | Lucas, Jr. | A61J 1/03 |
| 2021/0031969 | A1* | 2/2021 | Fahlke | B65D 5/38 |

FOREIGN PATENT DOCUMENTS

| | | | |
|---|---|---|---|
| CN | 201033661 | Y | 3/2008 |
| CN | 202321220 | U | 7/2012 |
| CN | 101873979 | B | 8/2012 |
| CN | 202575017 | U | 12/2012 |
| EP | 0573859 | A2 | 7/1996 |
| EP | 2595898 | B1 | 8/2017 |
| WO | 2012011941 | A1 | 1/2012 |
| WO | 2018064396 | A1 | 4/2018 |

* cited by examiner

SELF-OPENING PACKAGING WITH CHILD-RESISTANT CLOSURE

FIELD OF THE INVENTION

The present disclosure relates to self-opening packaging and to child-resistant closures for self-opening packaging.

BACKGROUND

As used in the present disclosure, self-opening packaging or self-opening containers incorporate a mechanism that automatically opens a packaging cover or lid when actuated. For example, self-opening containers can include a push-button that automatically opens a lid of the container when the button is pressed, or a sliding actuator that automatically opens a cover of the container when the sliding actuator is displaced. Self-opening containers can embody efficient mechanical designs for opening lids and for accessing components such as internal receptacles. However, conventional self-opening containers generally are easily opened by children, which can be highly problematic in the case of containers of hazardous or age-restricted materials.

SUMMARY

What is needed are self-opening packaging that includes child-resistant closure. One need is for self-opening packaging for hazardous or age-restricted materials that reduces the risk of children accessing the hazardous or age-restricted materials. An additional need is packaging that combines the safety provided by child-resistant closure for use by children with a convenient self-opening mechanical design for use by adults.

A child-resistant self-opening container includes a container body having a front side, left side, right side, container bottom, and top opening. A child-resistant self-opening container incorporates an opening mechanism including a vertically extending linear guide slot at one of the front side, left side, and right side of the container body. The container also incorporates a child-resistant closure mechanism including shift button slidably mounted at the container bottom and a latch mechanism coupled to the shift button. The shift button is configured to be displaced between a first position and a second position, moving the latch mechanism between locked and unlocked configurations. The latch extends above the container bottom within an interior space of the container body.

The child-resistant self-opening container includes a lid connected to the container body adjacent the top opening and an inner casing mounted within the container body. The opening mechanism of the container includes a protuberance of the inner casing, which extends through the vertically extending linear guide slot in the container body. The inner casing is slidably mounted to rise and descend within the container body, and the protuberance is slidable within the vertically extending linear guide slot. The inner casing further includes a catch surface at a bottom portion of the inner casing.

The child-resistant self-opening container is configured to move the latch mechanism from a locked configuration to an unlocked configuration when the shift button is displaced from the first position to the second position. In the locked configuration, the latch mechanism abuts against the catch surface of the inner casing and prevents rising of the inner casing within the container body. In the unlocked configuration, the latch mechanism does not abut against the catch surface of the inner casing and does not prevent rising of the inner casing within the container body.

In an embodiment, the shift button includes a button body, and the latch mechanism comprises a latch pin attached to or integral with the button body. The latch pin includes a tip that abuts against the catch surface of the inner casing when the shift button is at the first position.

In an embodiment, the child-resistant closure mechanism further includes a compression spring attached to a button body of the shift button. The compression spring biases the shift button toward the first position and biases the latch mechanism toward the locked configuration.

In an embodiment, the child resistant self-opening container includes a first linkage coupling the lid to the inner casing to cause the lid to be opened at the top opening of the container body when the inner casing rises within the container body. In an embodiment, the child resistant self-opening container further includes a second linkage coupling the lid to the container body to guide movement of the lid during the opening of the lid.

In an embodiment, a child-resistant self-opening container comprises a container body including a front side, a left side, a right side, a container bottom, and a top opening; wherein one of the front side, left side, and right side defines a vertically extending linear guide slot; a shift button slidably mounted at the container bottom and configured to be displaced between a first position and a second position; and a latch mechanism coupled to the shift button and extending above the container bottom within an interior space of the container body; a lid connected to the container body adjacent the top opening; and an inner casing including a protuberance that extends through the vertically linear guide slot; wherein the inner casing is slidably mounted to rise and descend within the container body and the protuberance is slidable within the vertically extending linear guide slot; and a catch surface at a bottom portion of the inner casing; wherein in the event the shift button is displaced from the first position to the second position, the latch mechanism moves from a locked configuration to an unlocked configuration; wherein in the locked configuration the latch mechanism abuts against the catch surface of the inner casing and prevents rising of the inner casing within the container body, and wherein in the unlocked configuration the latch mechanism does not abut against the catch surface of the inner casing and does not prevent rising of the inner casing within the container body.

In an embodiment, a child-resistant self-opening container comprises a container body including a container bottom, a top opening, and a vertically extending linear guide slot; a shift button slidably mounted at the container bottom and configured to be displaced between a first position and a second position; and a latch mechanism coupled to the shift button and extending above the container bottom within an interior space of the container body; an inner casing including a protuberance that extends through the vertically linear guide slot, wherein the inner casing is slidably mounted to rise and descend within the container body and the protuberance is slidable within the vertically extending linear guide slot; and a catch surface at a bottom portion of the inner casing; and a lid hinged to the container body adjacent the top opening, and a linkage coupling the lid to the inner casing to cause the lid to be opened at the top opening of the container body when the inner casing rises within the container body, wherein in the event the shift button is displaced from the first position to the second position, the latch mechanism moves from a locked configuration to an unlocked configuration, wherein in the locked configuration, the latch mechanism abuts against the catch surface of the inner casing and prevents rising of the inner casing within the container body, and wherein in the unlocked configuration, the latch mechanism does not abut against the catch surface of the inner casing and does not prevent rising of the inner casing within the container body.

BRIEF DESCRIPTION OF THE FIGURES

The present disclosure can be better understood by referring to the following figures. The components in the figures are not necessarily to scale, emphasis instead being placed upon illustrating the principles of the disclosure. In the figures, reference numerals designate corresponding parts throughout the different views.

DETAILED DESCRIPTION

Figure 1:
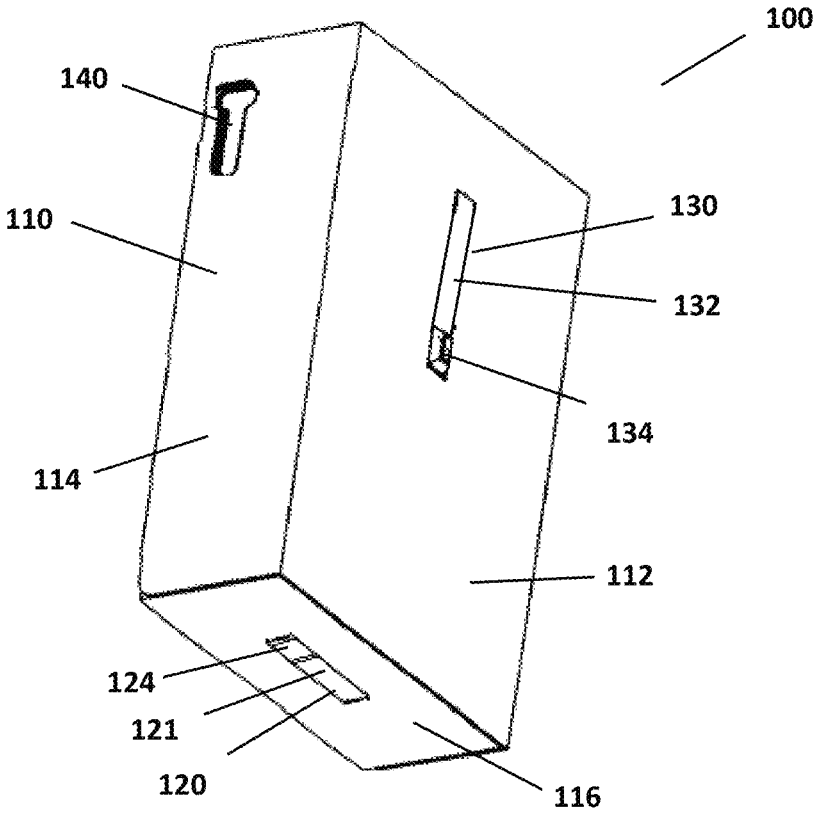
FIG. 1 is a perspective view from below of a self-opening container with child-resistant closure with lid closed, according to an embodiment.

The present disclosure is here described in detail with reference to embodiments illustrated in the drawings, which form a part here. Other embodiments may be used and/or other changes may be made without departing from the spirit or scope of the present disclosure. The illustrative embodiments described in the detailed description are not meant to be limiting of the subject matter presented here.

Reference will now be made to the exemplary embodiments illustrated in the drawings, and specific language will be used here to describe the same. It will nevertheless be understood that no limitation of the scope of the invention is thereby intended. Alterations and further modifications of the inventive features illustrated here, and additional applications of the principles of the inventions as illustrated here, which would occur to one skilled in the relevant art and having possession of this disclosure, are to be considered within the scope of the invention.

A self-opening container includes a container body, a container cover or lid, and an inner casing or receptacle that is slidably mounted in an inner cavity of the container body. The self-opening container incorporates an opening mechanism, which when actuated automatically raises the inner casing and opens the lid to provide access to container contents. Additionally, the self-opening container incorporates a child-resistant closure mechanism, also herein called a CR mechanism, which prevents operation of the opening mechanism when the child-resistant closure mechanism is in a locked configuration.

In an embodiment, the opening mechanism includes a linear guide slot (I-shaped aperture) on the container body, and a convex member or protuberance on the inner casing that extends through the linear guide slot to permit sliding movement along the length of the slot. In the present disclosure, these mechanisms are sometimes collectively called the opening slide mechanism. Upward or downward force on the protuberance, such as by pushing or pulling the protuberance, causes the inner casing to slide up or slide down within the container body. In various embodiments, the linear guide slot is located on the left side or right side of the container. In another embodiment, the linear guide slot is located on the front of the container.

In various embodiments, in addition to the opening slide mechanism the opening mechanism of the self-opening container further includes linkages or connecting parts that cause the container lid to open in response to upward movement of the inner casing within the container body, and that guide movement of the lid during opening. Coordinated raising of the inner container and opening of the box cover provides enhanced visibility and access to objects within the inner container in order to display or extract these objects.

In various embodiments, the self-opening container incorporates a child-resistant closure mechanism that includes a locked configuration and an unlocked or released configuration. In the locked configuration, the child-resistant closure mechanism prevents operation of the opening mechanism, such that upward force on the protuberance does not cause the inner casing to slide up within the container body and does not open the container lid. In the unlocked or released configuration, the child-resistant closure mechanism permits operation of the opening mechanism, such that upward force on the protuberance causes the inner casing to slide up within the container body and causes the container lid to open. In order to access contents of the container, a user must first move the child-resistant closure mechanism to its unlocked configuration, then exert upward force on the protuberance to operate the opening mechanism.

In an embodiment, the child-resistant closure mechanism includes a button or bar or other member slidably mounted to the container to move between locked and unlocked positions. In an embodiment, the button or bar is coupled to a latch member (e.g., latch pin), which engages a catch structure of the inner casing when the slide closure mechanism is in its locked position. Herein the button or bar is also called a shift button. In various embodiments, the latch member is integrally formed with the slide closure member or is rigidly fastened to the slide closure member, such that they move together between the locked and unlocked positions, also herein called first and second positions. Sliding movement of the shift button and latch member to their unlocked position disengages the latch member from the catch structure of the inner casing and permits upward movement of the inner casing relative to the container body.

In an embodiment, the child-resistant closure mechanism includes a compression spring or other mechanism that biases the child-resistant closure mechanism to its locked configuration. In various embodiments, the child-resistant closure mechanism includes a single shift button. In an embodiment, the single slide closure member is slidably mounted at the bottom of the container. In an alternative embodiment, the child-resistant closure mechanism includes two shift button, In alternative embodiments, one or more shift buttons is slidably mounted at side(s) of the container adjacent the container bottom.

In the present disclosure, the self-opening container is also called packaging, box, or container tin. In the present disclosure, the container lid is also called container cover or box cover. The inner casing is also called inner container or receptacle. The linear guide slot and the protuberance on the inner casing collectively are sometimes called opening slide mechanism. The protuberance is sometimes called a slide button. The child-resistant closure mechanism is sometimes called release mechanism. The shift button of the child-resistant closure mechanism is also herein called a shift bar or button body.

In various embodiments, the opening mechanism incorporates linkages of the container lid to the inner casing and container body that cause the container lid to open during upward movement of the inner casing. In an embodiment, both side surfaces of the inner casing carry a first linkage to the lid (also called first connecting part) close to the opening slide mechanism that transmits force from the inner casing to the lid to cause the lid to open or close when the opening slide mechanism raises or lowers the inner casing. In an embodiment, the lid carries a second linkage to the container body (also called second connecting part or positioning guide) to guide the movement of the lid during opening or closing the lid.

In various embodiments, the lid has no front surface, and the inner casing is a rectangular body with an open inner side. The self-opening container may be formed of various rigid and semi-rigid materials including without limitation metals such as tinplate, aluminum, galvanized iron, stainless steel; engineering plastics; and metal-plastic composites. In an embodiment, the lid, box body, and inner casing are stamped tinplate parts. In an embodiment, edges of the openings are formed as inwardly turned edges. In an embodiment, left and right sides of the container body are hooked by left and right hooks of the lid.

In an exemplary embodiment, the container of the present disclosure is employed as a self-opening cigarette box including a child-resistant closure mechanism that hinders access to cigarettes by children.

As shown in FIG. 1, the self-opening container 100 of the first embodiment includes a box body 110. The front surface 112 of the box body 110 is provided with an opening slide mechanism 130 including an I-shaped linear guide slot 132 and a slide button 134. A left side 114 of the container includes a T-shaped positioning guide 140. In an embodiment, another T-shaped positioning guide is located on the right side, as shown at 340 in FIG. 3. The bottom 116 contains a child-resistant closure mechanism 120 including a protuberance or slide button 124 slidably mounted within slot 222.

Figure 2:
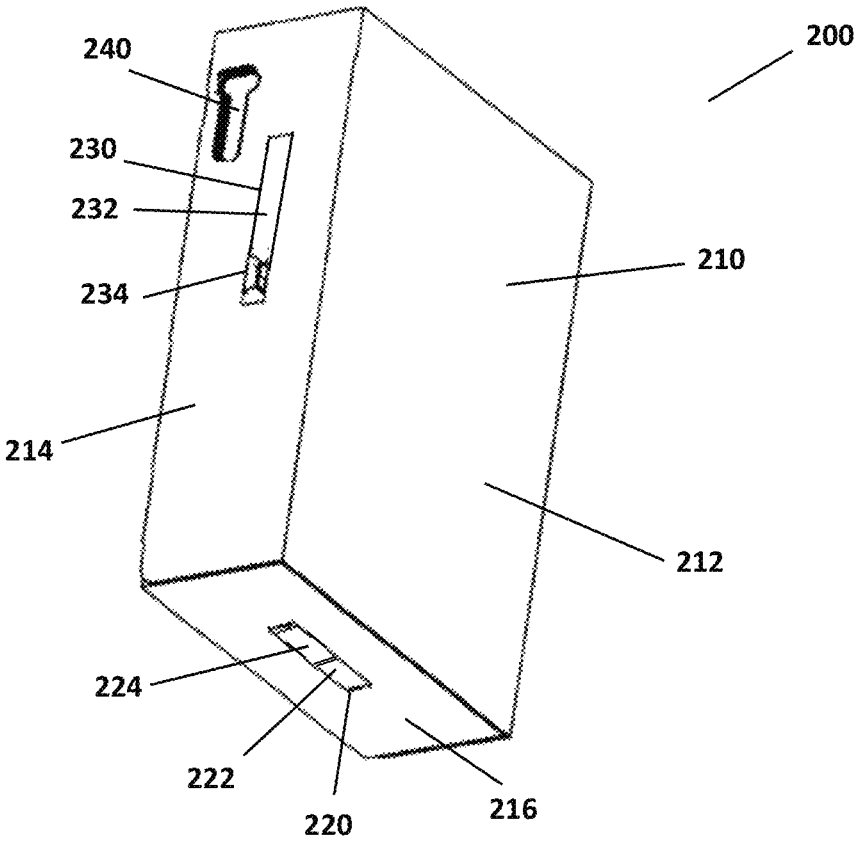
FIG. 2 is a perspective view from below of a self-opening container with child-resistant closure with lid closed, according to another embodiment.

In an alternative embodiment, as shown in FIG. 2, the self-opening container 200 include opening slide mechanism 230 including an I-shaped linear guide slot 232 and a protuberance or slide button 234 at the left side 214 of the container. As compared with FIG. 1, the arrangement of FIG. 2 leaves the front 212 of the container body 210 uninterrupted to display indicia, graphics, and the like. The child-resistant closure mechanism 220 including a slide bar 224 slidably mounted within slot 222.

Figure 3:
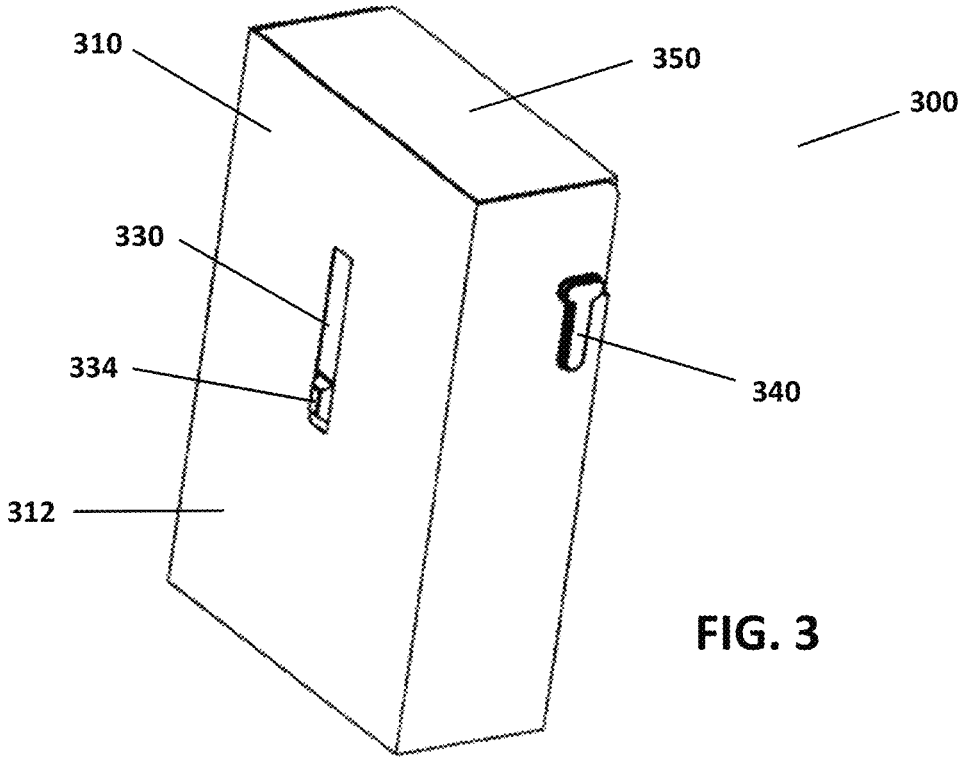
FIG. 3 is a perspective view from above of the self-opening container with child-resistant closure with lid closed of FIG. 1, according to an embodiment.

As shown in FIG. 3, the lid 350 of container 300 is closed, and the protuberance 334 of opening slide mechanism 330 is at its lower extreme, i.e., at a fully closed position.

Figure 4:
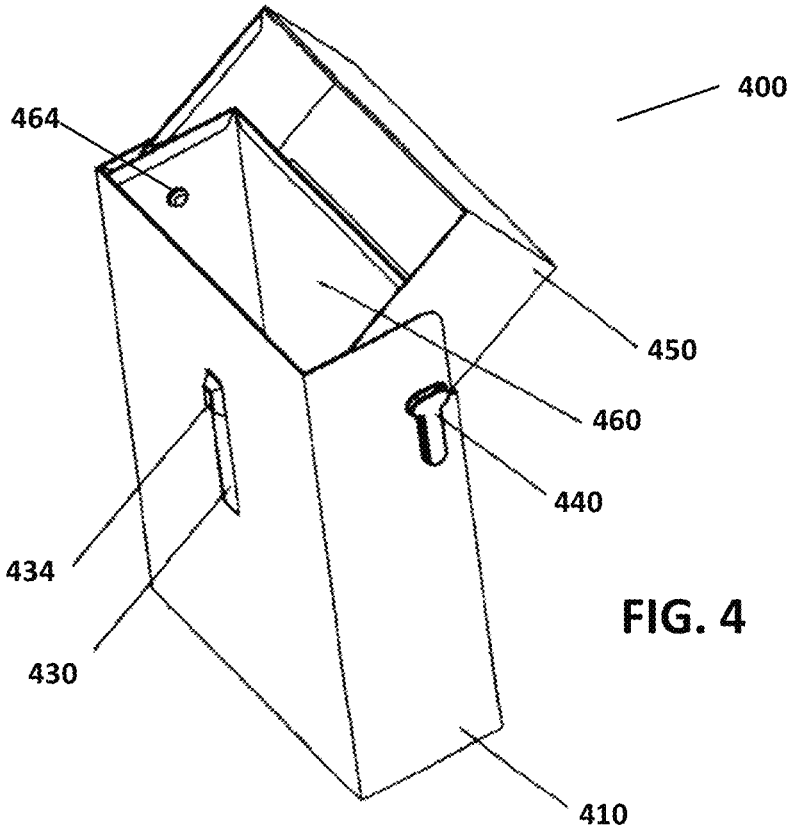
FIG. 4 is a perspective view from above of a self-opening container with child-resistant closure with lid opened, according to an embodiment.

In the container 400 of FIG. 4, the lid 450 is opened and the protuberance 434 of opening slide mechanism 430 is at its upper extreme, i.e., the protuberance 434 of the opening slide mechanism 430 has been actuated to a fully open position. The opened lid 450 is pivoted toward the rear of the container, revealing inner case 460. The first connecting part or first linkage for raising and lowering the lid 450 is shown at the left side of inner case 460 at 464.

Figure 5:
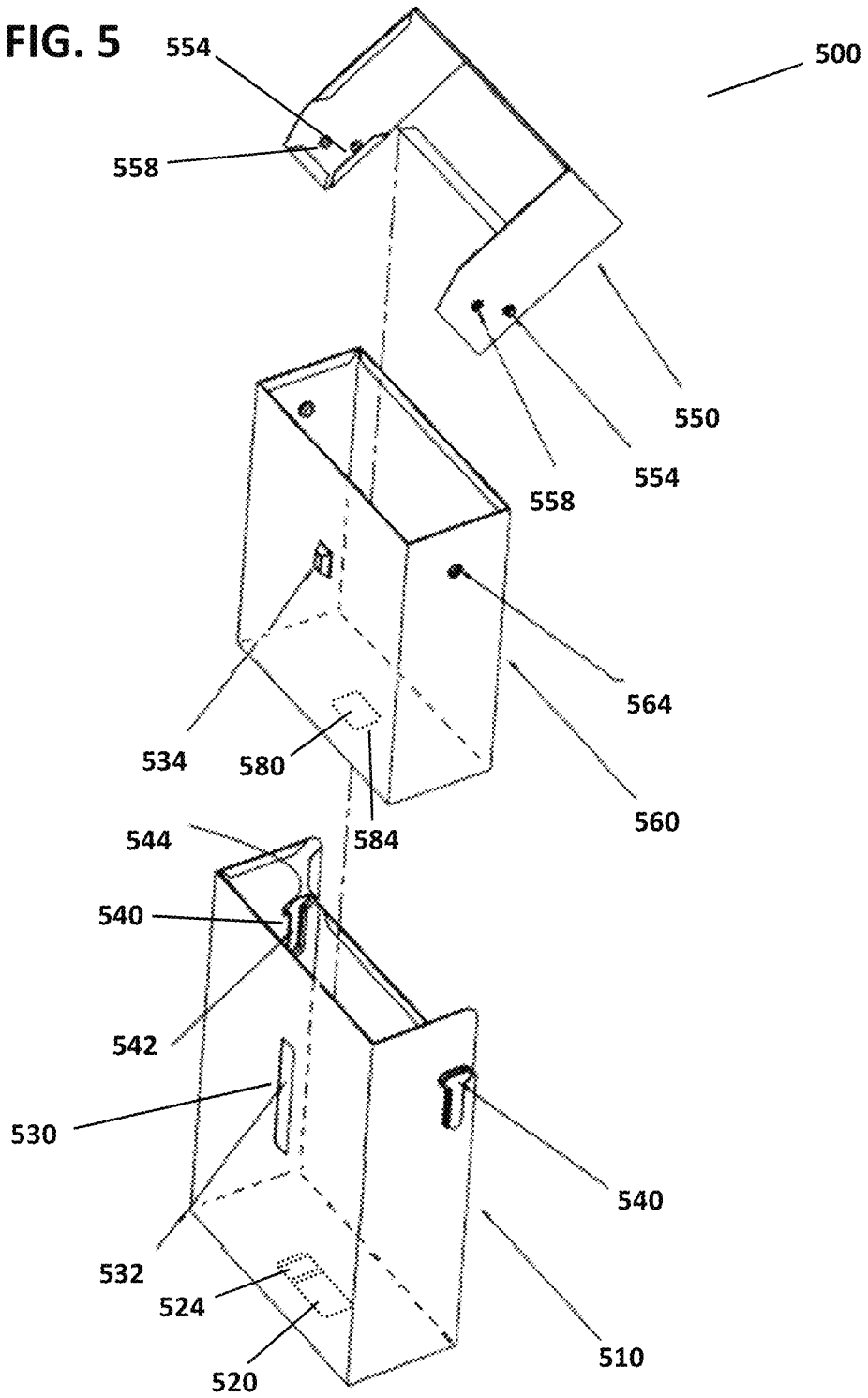
FIG. 5 is an exploded front perspective view from above of a self-opening container with child-resistant closure, according to an embodiment.

Another first connecting part couples the lid to the right side of the inner case 460, as shown by connectors 558, 564 in FIG. 5. In the embodiment of FIG. 5, the first connecting part includes a connector 558 at a lower portion of each side the lid 550, which provides a pivotal connection to a connector 564 at an upper portion of each side of inner case 560. This connection hinges the lid to the container body 410, so that the lid can swivel during opening, e.g., toward the rear of the container.

As shown in FIG. 5, inner container 560 provides an inner lining that is slidably mounted in an interior cavity of container body 510. Inner container 560 carries a protuberance 534 centrally located on the front surface of inner container 560, configured to extend through the vertically extending linear guide slot 532 of opening slide mechanism 530 at the front of container body 510. The inner casing 560 is slidably mounted to rise and descend within the container body 510, and the protuberance 534 is slidable within the linear guide slot 532.

A second linkage or second connecting part includes T-shaped positioning guides 540 at upper portions of the left and right sides of the lid 510 and follower pins 554 at the left and right sides of the box cover 550. Each of the T-shaped positioning guides 540 includes a vertical lower section 542 and a transverse upper section 544. As the lid 550 rises in coordination with the inner case 560, follower pins 554 first move upwardly through the vertical lower section 542, then move to one side of the transverse upper section 544 of the T-shaped positioning guides. During opening of container 500 this movement causes the box cover 550 first to move vertically out of the box body 510, then to swivel to one side, e.g., toward the rear of container 500. The box cover 550 follows a reverse motion path during closing of container 500.

Child resistant closure 520 with slide button 524 are located at the bottom surface of container body 510, here shown in phantom. As described with reference to FIGS. 6A-6C, components of the child resistant closure 520, some of which are not shown in FIG. 5, are configured to interact with a catch structure at the bottom of the inner case 560 to provide locked and unlocked configurations of the CR mechanism. In an embodiment, this catch structure (here shown in phantom) includes a rectangular aperture 580 and a catch surface 584 adjacent the right edge of the rectangular aperture 580.

Figure 6A:
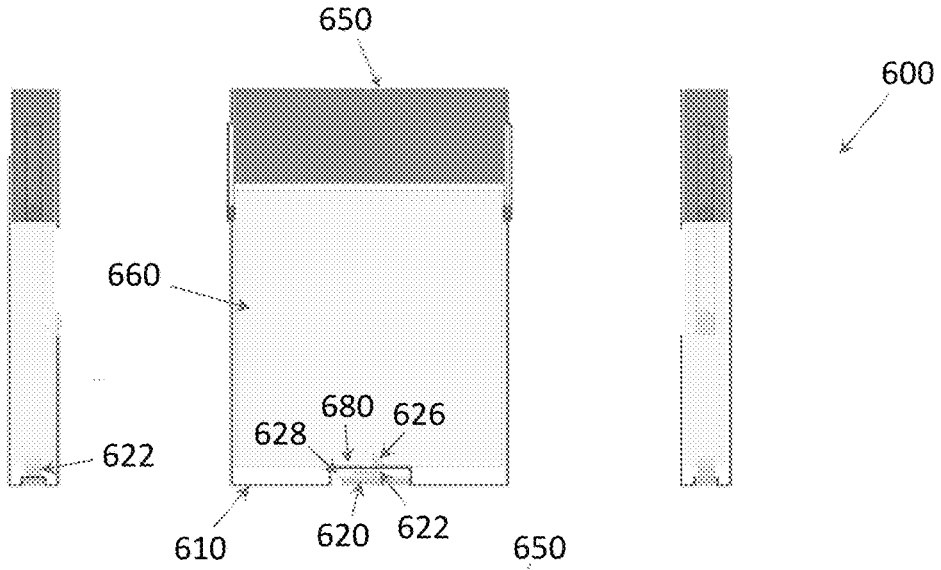
FIG. 6A shows left-side, front, and right-side elevation views of a self-opening container with child-resistant closure showing a first stage of a container opening procedure, according to an embodiment.
Figure 6B:
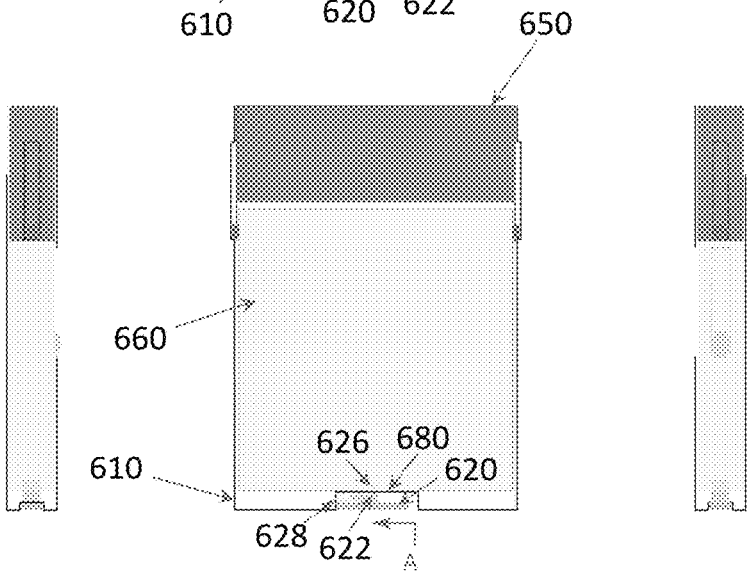
FIG. 6B shows left-side, front, and right-side elevation views of a self-opening container with child-resistant closure showing a second stage of a container opening procedure, according to the embodiment of FIGS. 6A-6C.
Figure 6C:
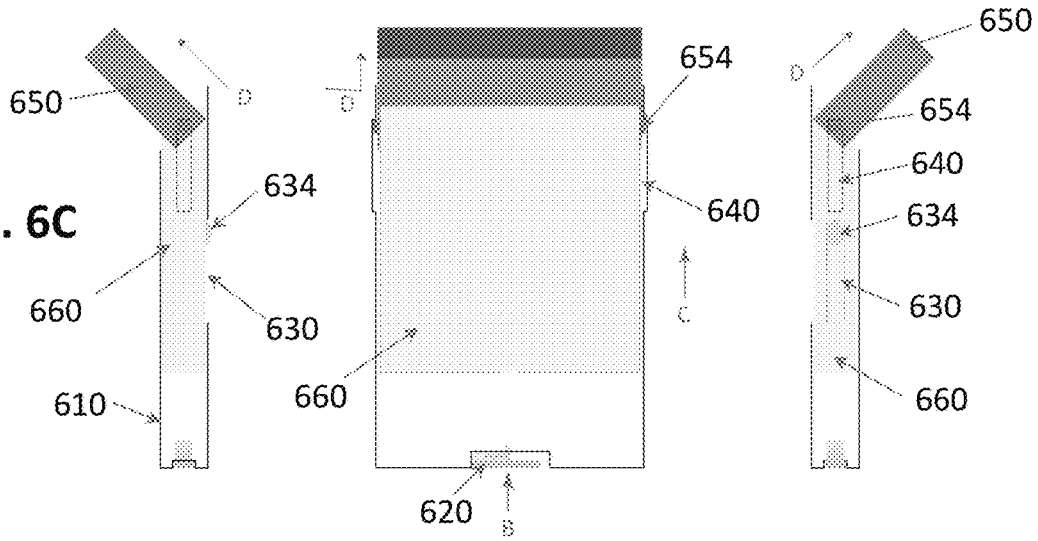
FIG. 6C shows left-side, front, and right-side elevation views of a self-opening container with child-resistant closure showing a third stage of a container opening procedure, according to the embodiment of FIGS. 6A-6C.

FIGS. 6A-6C show several stages of a process for opening a self-opening CR container 600. These views show somewhat schematically structures of a child-resistant closure mechanism located at the bottom of container body 610 and the bottom of inner container 660, and show operation of the child-resistant closure mechanism in the process for opening the container 600. Each of FIGS. 6A-6C shows container 600 from several perspectives: a left-side elevation view, a front elevation view, and a right-side elevation view.

As shown in FIG. 6A, the child-resistant closure mechanism includes a button or bar 620, also herein called a button body, slidably mounted in a slide channel at the bottom of container body 610. The button body 620 is configured to move between a first position to at the right end of the slide channel and a second position at the left end of the slide channel. A latch pin 622 extends above the button body within the interior of the container body 610. In an embodiment, the latch pin 622 includes a tip 626 (e.g., substantially triangular structure) at an upper end of the latch pin. In an embodiment shown in FIGS. 5 and 6A, the catch structure includes an aperture 580 at the bottom of the inner container and a catch surface 584 at the right edge of this aperture that is engaged by the latch pin tip 626 at the first (locked) position of the closure mechanism. In an embodiment, the latch pin 622 and catch structure 680 define a button hook closure mechanism. Additionally, the child-resistant closure mechanism includes a compression spring 628 that biases the button body 620 to its first position with the child-resistant closure mechanism to the locked configuration of FIG. 6A, in the absence of user action moving the slide button 620 toward the second position. In various embodiments, the CR mechanism may include other structures such as support structures, other actuating members, and other locations adjacent the bottom of the inner container.

When the closure button 620 is positioned to the right, as shown in FIG. 6A, the latch pin tip engages a latch structure of the inner container 660 and prevents the inner container from rising. At the stage shown in FIG. 6B, the user exerts a force on the slide button toward the left as shown by arrow A. This movement disengages the latch mechanism 622 from the catch structure 680, and releases the inner container 660 to permit the inner container to rise within the container body 610.

The CR release action shown in FIG. 6B is the first user action in the process for opening the self-opening child-resistant container 600. At the process stage shown in FIG. 6C, the user continues to exert a force on the child-resistant closure mechanism toward the left to maintain this mechanism in its unlocked configuration, and raises the inner container 660 and opens the container lid 650 using the opening slide mechanism 630. While maintaining the CR mechanism in its released configuration as shown at arrow B, the user pushes up the slide button 634 to raise the inner case 660 as shown at arrow C. The linkage 640, 654 opens the lid 650 as shown at arrows D.

In an alternative embodiment, the child-resistant closure mechanism includes two shift buttons respectively located at left and right sides of the container body adjacent the bottom of the container. Each shift button is fixedly coupled to a respective latch mechanism, e.g., via a button body of the shift button. For each shift button, a respective compression spring biases the shift button and respective latch mechanism to a first position. At the first position, each latch mechanism abuts against a respective catch surface of two opposing catch surfaces associated with the inner container to prevent the inner container from rising within the container body, i.e., the locked configuration of the child-resistant closure mechanism. When the user slides both shift buttons to a second position to overcome the compression spring bias, each respective latch mechanism no longer abuts against the respective catch surface and permits the inner container to rise within the container body, i.e., the unlocked configuration of the child-resistant closure mechanism.

The foregoing method descriptions and the interface configuration are provided merely as illustrative examples and are not intended to require or imply that the steps of the various embodiments must be performed in the order presented. As will be appreciated by one of skill in the art the steps in the foregoing embodiments may be performed in any order. Words such as "then," "next," etc. are not intended to limit the order of the steps; these words are simply used to guide the reader through the description of the methods. Although process flow diagrams may describe the operations as a sequential process, many of the operations can be performed in parallel or concurrently. In addition, the order of the operations may be re-arranged. A process may correspond to a method, a function, a procedure, a subroutine, a subprogram, etc. When a process corresponds to a function, its termination may correspond to a return of the function to the calling function or the main function.

What is claimed is:

1. A child-resistant self-opening container, comprising:

a container body including a front side, a left side, a right side, a container bottom, and a top opening; wherein one of the front side, left side, and right side defines a vertically extending linear guide slot; a shift button slidably mounted at the container bottom and configured to be displaced between a first position and a second position; and a latch mechanism coupled to the shift button and extending above the container bottom within an interior space of the container body;

a lid connected to the container body adjacent the top opening; and an inner casing including a protuberance that extends through the vertically linear guide slot; wherein the inner casing is slidably mounted to rise and descend within the container body and the protuberance is slidable within the vertically extending linear guide slot; and a catch surface at a bottom portion of the inner casing, wherein in the event the shift button is displaced from the first position to the second position, the latch mechanism moves from a locked configuration to an unlocked configuration, wherein in the locked configuration, the latch mechanism abuts against the catch surface of the inner casing and prevents rising of the inner casing within the container body, and wherein in the unlocked configuration, the latch mechanism does not abut against the catch surface of the inner casing and does not prevent rising of the inner casing within the container body.

2. The child resistant self-opening container of claim 1, wherein the shift button includes a button body, and the latch mechanism comprises a latch pin attached to or integral with the button body.

3. The child resistant self-opening container of claim 2, wherein the latch pin includes a tip that abuts against the catch surface of the inner casing when the shift button is at the first position.

4. The child resistant self-opening container of claim 1, wherein the latch mechanism comprises a button hook closure mechanism.

5. The child resistant self-opening container of claim 1, wherein the inner casing includes an aperture at a bottom surface of the inner casing and the catch surface is located adjacent the aperture.

6. The child resistant self-opening container of claim 2, further comprising a compression spring attached to the button body, wherein the compression spring biases the shift button toward the first position and biases the latch pin toward the locked configuration.

7. The child resistant self-opening container of claim 1, further comprising a first linkage coupling the lid to the inner casing to cause the lid to be opened at the top opening of the container body when the inner casing rises within the container body.

8. The child resistant self-opening container of claim 7, further comprising a second linkage coupling the lid to the container body to guide movement of the lid during the opening of the lid.

9. The child resistant self-opening container of claim 8, wherein the second linkage comprises a T-shaped positioning guide.

10. The child resistant self-opening container of claim 1, wherein the lid is hinged to the container body adjacent the top opening.

11. The child resistant self-opening container of claim 1, wherein the inner casing is a rectangular body that is opened at an inner side.

12. The child resistant self-opening container of claim 1, wherein the front side of the container body defines the vertically extending linear guide slot.

13. The child resistant self-opening container of claim 1, wherein comprises one of the left side and the right side of the container body defines the vertically extending linear guide slot.

14. A child-resistant self-opening container, comprising:

a container body including a container bottom, a top opening, and a vertically extending linear guide slot; a shift button slidably mounted at the container bottom and configured to be displaced between a first position and a second position; and a latch mechanism coupled to the shift button and extending above the container bottom within an interior space of the container body;

an inner casing including a protuberance that extends through the vertically linear guide slot, wherein the inner casing is slidably mounted to rise and descend within the container body and the protuberance is slidable within the vertically extending linear guide slot; and a catch surface at a bottom portion of the inner casing; and a lid hinged to the container body adjacent the top opening, and a linkage coupling the lid to the inner casing to cause the lid to be opened at the top opening of the container body when the inner casing rises within the container body, wherein in the event the shift button is displaced from the first position to the second position, the latch mechanism moves from a locked configuration to an unlocked configuration, wherein in the locked configuration, the latch mechanism abuts against the catch surface of the inner casing and prevents rising of the inner casing within the container body, and wherein in the unlocked configuration, the latch mechanism does not abut against the catch surface of the inner casing and does not prevent rising of the inner casing within the container body.

15. The child resistant self-opening container of claim 14, wherein the shift button includes a button body, and the latch mechanism comprises a latch pin attached to or integral with the button body with a tip that abuts against the catch surface of the inner casing when the shift button is at the first position.

16. The child resistant self-opening container of claim 14, wherein the latch mechanism comprises a button hook closure mechanism.

17. The child resistant self-opening container of claim 14, further comprising a compression spring attached to the button body, wherein the compression spring biases the shift button toward the first position and biases the latch mechanism toward the locked configuration.

18. The child resistant self-opening container of claim 14, further comprising a second linkage coupling the lid to the container body to guide movement of the lid while the lid is opened at the top opening of the container body.

19. The child resistant self-opening container of claim 14, wherein a front side of the container body defines the vertically extending linear guide slot.

20. The child resistant self-opening container of claim 14, wherein one of a left side and a right side of the container body defines the vertically extending linear guide slot.

* * * * *